US007247003B2

(12) United States Patent
Burke et al.

(10) Patent No.: US 7,247,003 B2
(45) Date of Patent: Jul. 24, 2007

(54) STACKED LAMELLATE ASSEMBLY

(75) Inventors: Michael A. Burke, Pittsburgh, PA (US); Jay A. Morrison, Oviedo, FL (US); Steven James Vance, Orlando, FL (US); Daniel G. Thompson, Pittsburgh, PA (US); Vijay Parthasarathy, Escondido, CA (US); Gary B. Merrill, Orlando, FL (US); Douglas Allen Keller, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 220 days.

(21) Appl. No.: 11/031,797

(22) Filed: Jan. 7, 2005

(65) Prior Publication Data

US 2006/0120874 A1 Jun. 8, 2006

Related U.S. Application Data

(63) Continuation-in-part of application No. 11/002,028, filed on Dec. 2, 2004.

(51) Int. Cl.
*F01D 5/14* (2006.01)

(52) U.S. Cl. ..... 416/229 R; 416/229 A; 416/241 B

(58) Field of Classification Search ..... 416/230, 416/229 A, 229 R, 241 B
See application file for complete search history.

(56) References Cited

U.S. PATENT DOCUMENTS

| | | | | |
|---|---|---|---|---|
| 1,488,243 | A * | 3/1924 | Haw | 416/229 R |
| 2,853,271 | A * | 9/1958 | Findley | 416/229 R |
| 3,301,526 | A | 1/1967 | Chamberlain | |
| 3,378,228 | A | 4/1968 | Davies et al. | |
| 3,515,499 | A | 6/1970 | Beer et al. | |
| 3,619,077 | A | 11/1971 | Will et al. | |
| 3,942,231 | A | 3/1976 | Whitaker | |
| 4,260,326 | A | 4/1981 | Scott et al. | |
| 4,270,883 | A | 6/1981 | Corrigan | |
| 4,314,794 | A * | 2/1982 | Holden et al. | 416/229 A |
| 4,583,274 | A | 4/1986 | Moracz et al. | |
| 4,671,470 | A | 6/1987 | Jonas | |
| 4,752,712 | A | 6/1988 | Tomita et al. | |
| 5,279,892 | A | 1/1994 | Baldwin et al. | |
| 5,375,978 | A | 12/1994 | Evans et al. | |
| 5,755,558 | A | 5/1998 | Reinfelder et al. | |
| 5,939,007 | A | 8/1999 | Iszczyszyn et al. | |
| 6,159,407 | A | 12/2000 | Krinke et al. | |
| 6,305,924 | B1 | 10/2001 | Krinke et al. | |
| 6,341,942 | B1 | 1/2002 | Chou et al. | |
| 6,431,837 | B1 | 8/2002 | Velicki | |
| 2004/0150095 | A1 | 8/2004 | Fraley et al. | |

* cited by examiner

*Primary Examiner*—Richard A. Edgar

(57) ABSTRACT

A stacked ceramic matrix composite lamellate assembly (10) including shear force bearing structures (48) for resisting relative sliding movement between adjacent lamellae. The shear force bearing structures may take the form of a cross-lamellar stitch (50), a shear pin (62), a warp (90) in the lamellae, a tongue (104) and groove (98) structure, or an inter-lamellar sealing member (112), in various embodiments. Each shear force bearing structure secures a subset of the lamellae, with at least one lamella being common between adjacent subsets in order to secure the entire assembly.

13 Claims, 4 Drawing Sheets

STACKED LAMELLATE ASSEMBLY

CROSS REFERENCE TO RELATED APPLICATIONS

This application is a continuation-in-part of U.S. application Ser. No. 11/002,028, filed Dec. 2, 2004.

FIELD OF THE INVENTION

This invention relates generally to the field of turbine engines, and more specifically to an airfoil-shaped lamellate assembly.

BRIEF DESCRIPTION OF THE DRAWINGS

The invention is explained in following description in view of the drawings that show.

DETAILED DESCRIPTION OF THE INVENTION

Figure 1:
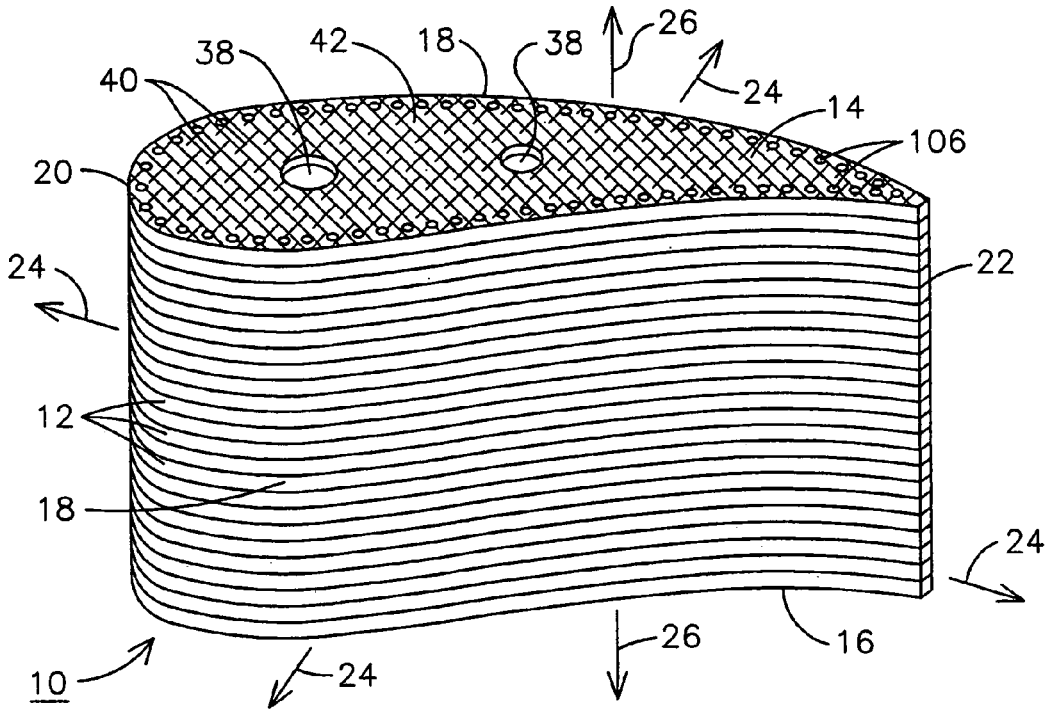
FIG. 1 is an isometric view of a turbine vane airfoil formed by a plurality of ceramic matrix composite lamellae.

The referenced parent of the present patent application describes a turbine vane assembly and a ceramic matrix composite (CMC) lamella used to construct such a turbine vane assembly. FIG. 1 illustrates one such vane assembly 10 made of a plurality of CMC lamellae 12. The vane 10 has a radially outer end 14, a radially inner end 16, an outer peripheral surface 18 defining an airfoil shape, a leading edge 20 and a trailing edge 22. Each lamella 12 can be substantially flat in an in-plane direction 24, with a through thickness direction 26 that is substantially normal to the in-plane direction 24. The lamellae 12 can be made of a CMC material including a plurality of reinforcing fibers 40 surrounded by a matrix material 42, with the fibers 40 oriented generally in the in-plane direction 24 to give each lamella anisotropic strength characteristics, wherein the in-plane tensile strength of each lamella is substantially greater than its through thickness tensile strength. The in-plane tensile strength can be at least three times greater than the through thickness tensile strength, or ten times greater, or 25–30 times greater than the through thickness tensile strength in various embodiments. In one embodiment, the CMC material may be an oxide-oxide material, with the fibers 40 provided as a woven fabric, blanket, tape or mat.

Figure 2:
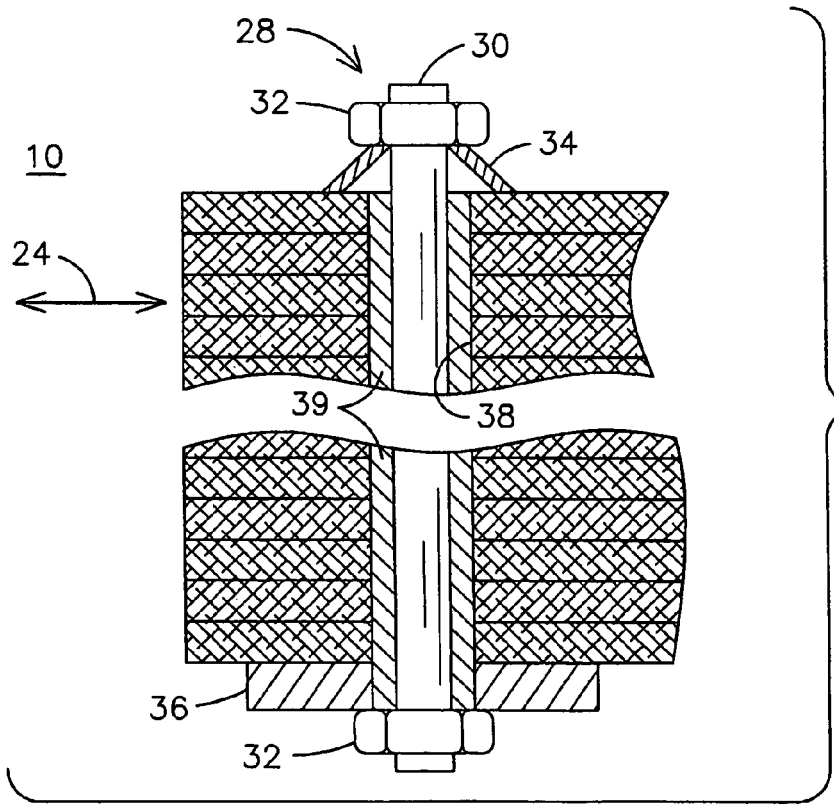
FIG. 2 is a partial cross-sectional view of the airfoil of FIG. 1 illustrating the installation of a fastening system for radially pre-compressing the lamellate assembly.

As described in the referenced parent patent application, the lamellae 12 can be held together by one or more fasteners 28, such as the combination of rod 30 and nuts 32 shown in FIG. 2. The rod 30 passes through respective radially aligned openings 38 formed in each respective lamella 12. A compliant member such as a Bellville or conical washer 34 may be used with or without a load-spreading member 36 to accommodate thermal expansion while maintaining a compressive pre-load on the assembly 10. In addition to or apart from using such fasteners 28, adjacent laminates 12 may be bonded to each other by using a bonding material or by sintering adjacent lamella 12 together. Alternatively, the lamellae 12 can be joined together through co-processing of partially processed individual laminates using methods such as chemical vapor infiltration, slurry or sol-gel impregnation, polymer precursor infiltration and pyrolysis, melt infiltration, etc. In these cases, partially densified individual lamella are formed, stacked, and then fully densified and/or fired as an assembly, thus forming a continuous matrix material phase in and between the lamellae. A sealing material 39 may be applied along the surface defining the opening 38 to prevent the leakage of air into/out of the opening 38. Such sealing material 39 may be a silicate-based glaze material, such as alumina silicate, that has a lower operating temperature limit than the material of the lamella because it is maintained at a lower temperature as a result of the cooling action of the air passing through the opening 38. In another embodiment a drilling process used to create the opening 38 after the lamellae are stacked may create a layer of sealing material 39 by partially melting a portion of the lamellae material.

An airfoil assembly 10 formed by the above-described methods is relatively strong in the in-plane directions 24 within a given lamella 12 as a result of the strength of the CMC reinforcing fibers 40; for example, having an in-plane tensile strength from about 150–200 Mpa and an in-plane compressive strength of about 140–160 MPa. The assembly 10 is also relatively strong in compression along the through thickness direction 26, for example having a compressive strength of about −251 to −314 MPa. However, the assembly 10 is relatively weak in resisting bending moments or torsional moments about the through thickness axis 26, i.e. in resisting sliding rotation between adjacent lamellae 12, such as may be caused by twisting aerodynamic loads during use of the airfoil 10 in a gas turbine engine. For a clamped assembly, the resistance of the assembly 10 to in-plane sliding movement between adjacent lamellae 12 is a function of the sliding friction between the adjoined surfaces and the applied clamping force. When adjacent lamellae 12 of the vane assembly 10 are held together only by the compressive pre-load imposed by the fastener 28, there is a chance that the pre-load will diminish over time or during periods of thermal transients due to the differential thermal expansion between the metal fasteners 28 and CMC lamella 12. This can reduce the friction force between adjacent lamellae 12. In extreme circumstances, air leakage and/or relative movement between adjacent lamellae 12 may occur. Even a small amount of movement between adjacent lamellae 12 can create a significant change in the efficiency of the outer airfoil shape, and further may cause premature failure of any thermal barrier coating applied to the airfoil surface. The rod 30 will not prevent such movement since a gap exists between the rod 30 and the sides of the surrounding opening 38. As such, the rod 30 is not a shear force bearing structure but rather is only a tensile load bearing member. Even for embodiments where the adjacent lamellae 12 are bonded together, such as with a bonding agent or by sintering or processing as described above, the strength of the bond in the in-plane direction 24 is significantly less than the in-plane strength of the lamella 12 themselves, since the inter-laminate bond region does not contain reinforcing fibers.

The present inventors have developed an improved laminated airfoil concept wherein adjacent laminates are mechanically interlocked with a shear force bearing structure to increase the load carrying capability of the airfoil and to avoid problems associated with a relaxation of a compressive radial pre-load imposed on the airfoil. A plurality of shear force bearing structures separate from the fastener are disposed to resist sliding movement in an in-plane direction between adjacent ones of the lamellae. Each shear force bearing structure is in contact with a grouped subset of the plurality of lamellae. Each subset includes at least one lamella in common with another subset so that collectively the plurality of shear force bearing structures secure all of the lamellae against relative sliding movement. The shear force bearing structures may take any of several forms, and they may serve an additional function such as providing a flow path for cooling air or providing an air seal between adjacent laminates, as described more fully below.

Figure 3:
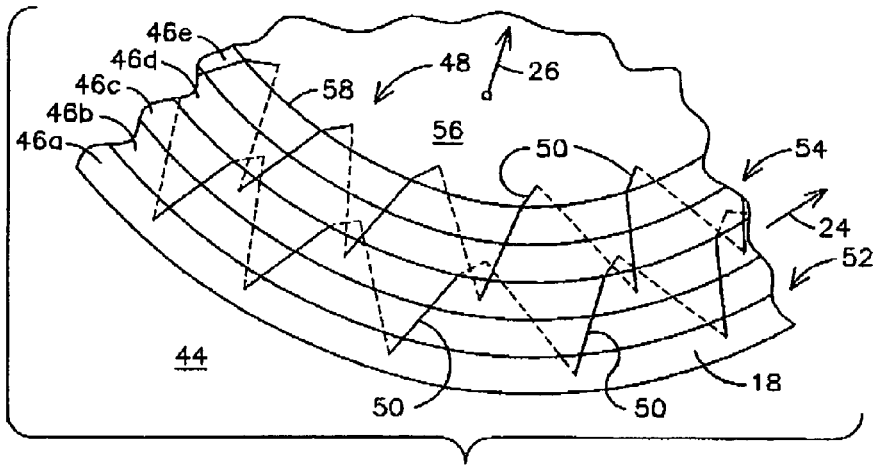
FIG. 3 is a partial perspective view of a lamellate airfoil incorporating a shear force bearing structure in the form of thru-lamellae stitching.

One embodiment of an improved lamellate airfoil assembly 44 is illustrated in FIG. 3, wherein five stacked lamellae 46*a*, 46*b*, 46*c*, 46*d* and 46*e* are joined by a shear force bearing structure 48. The assembly 44 is discussed as an airfoil; however, one skilled in the art will appreciate that other gas turbine parts such as combustion liners, burner inserts, transitions, etc. may be constructed in a similar manner. In this embodiment, the shear force bearing structure 48 comprises one or more fiber stitches 50 disposed between respective adjoining lamellae surfaces. The stitches 50 may be any material compatible with the lamellae material. For example, when the lamellae are formed of an oxide-oxide CMC material, the stitches may be made of the same oxide fiber as are the reinforcing fibers of the CMC material. Each fiber stitch 50 is generally aligned at least in part in the through thickness direction 26 to span the interfaces between a subset of the lamellae. FIG. 3 shows two rows of stitches 50. A first row 52 of stitches 50 joins a subset of lamellae 46*a*, 46*b* and 46*c*, and a second row 54 of stitches 50 joins a different subset of the lamellae 46*c*, 46*d* and 46*e*. In this manner, lamella 46*c* is part of two different subsets of lamellae and is secured both to layers above and below itself, thereby providing a desired degree of shear force bearing capability for the entire lamellate assembly. The stitches in rows 52, 54 may be offset from each other along the in-plane direction 24, thus avoiding interference between the stitches of adjacent rows within lamella 46*c*.

Figure 9:
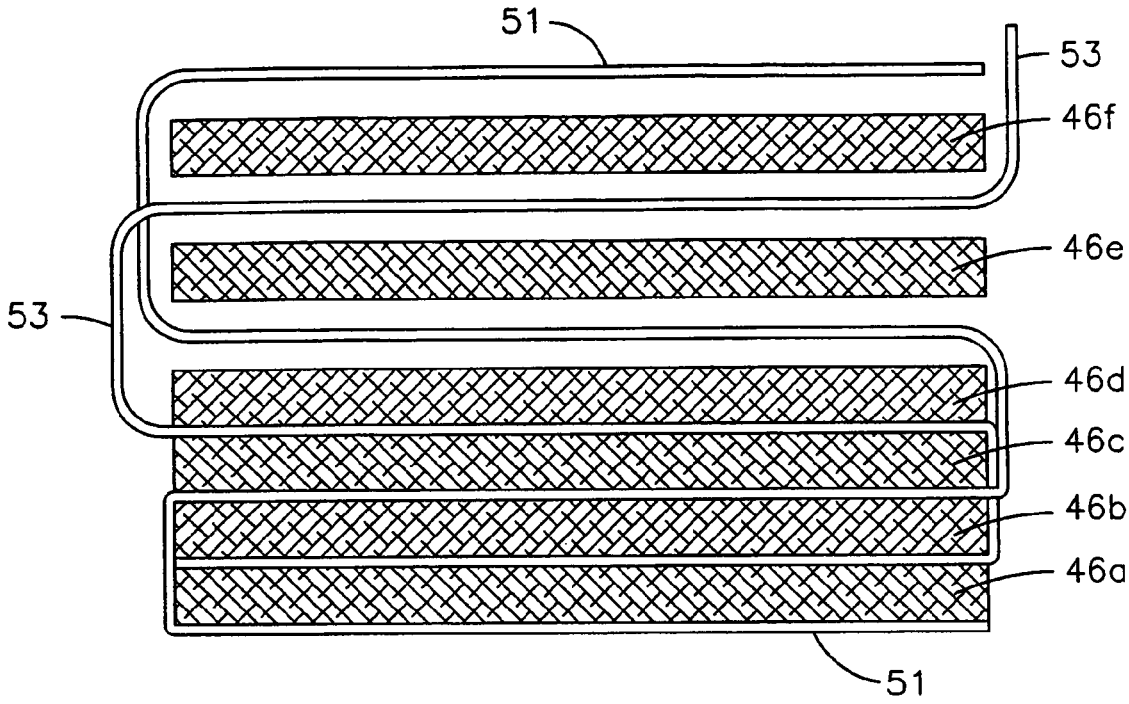
FIG. 9 is an end view of a lamellate assembly wherein pre-fired lamellae are interconnected by stitches.

The stitching of subsets of lamellae can be done as the lamellae are being laid up. Any subset of several individual lamellae can be laid up at a time and stitched as a single lamellae lot, or individual lamella can be stitched one at a time, or any combination thereof. The location of the stitching may be selected to optimize the assembly performance and/or to simplify the stitching operation, such as by performing stitching from both sides of a lamellae stack or from only one side. For an airfoil embodiment, stitching from one side only will allow the unstitched side to preferentially deform. This capability may be important where one side is exposed to a higher temperature during operation in order to allow the assembly to flex to better withstand thermal fatigue. One or more layers of stitches 50 can overlap each other, with several layers of lamellae being in common between adjacent lamellae subsets or with only one lamella being in common (as illustrated by layer 46*c* in FIG. 3). Each stitch 50 may be inserted into a top surface 56 of a top lamella at a distance from an edge 58 of the material, and the stitch 50 may extend at an angle such that it emerges a desired distance below the edge 58 along the outer peripheral surface 18. The stitch 50 is then drawn up along the outer peripheral surface 18 onto the top surface 56 to the location of the entry of the next stitch. Portions of the stitches 50 that are sub-surface are illustrated in phantom in FIG. 3. The exposed portion of the stitches 50 along the outer peripheral surface 18 may subsequently be covered by a layer of insulation or otherwise protected from the environment. The fiber may be a continuous fiber along the paths shown in FIG. 3, or it may be a doubled fiber that forms a loop (not shown) where it emerges from a surface that is then fixed by a second fiber passing through the loop. For CMC lamellae, the stitching may be done with the lamella fibers dry or after they have been infused with matrix precursor material. The stitching fiber may be infiltrated with matrix precursor prior to stitching. After stitching, the stacked laminate assembly 44 is fired to its final form. In one embodiment, the stitching fiber 50 may be selected and processed so that, upon final firing, the fibers 50 shrink relative to the lamellae matrix material, thereby causing compressive stresses to be applied to the lamellae. This may be accomplished by selecting the material of the fibers to exhibit greater shrinkage during firing than that of the lamellae, or by at least partially pre-curing the lamellae prior to the initial firing of the stitches. This has the advantage of reducing porosity in the matrix of the final product and of placing the lamellae 12 and the inter-lamellar matrix material in compression during service of the airfoil 44. Pre-fired or bisque-fired lamellae 46*a*–46*f* may also be stitched together without penetrating the hardened lamellae by weaving one or more threads (or ropes) 51, 53 between and along the edges of adjacent lamellae, as illustrated in FIG. 9. The threads 51, 53 may be made integral with the adjoined lamellae 46*a*–46*f* by co-firing the assembly following final compaction.

Figure 4:
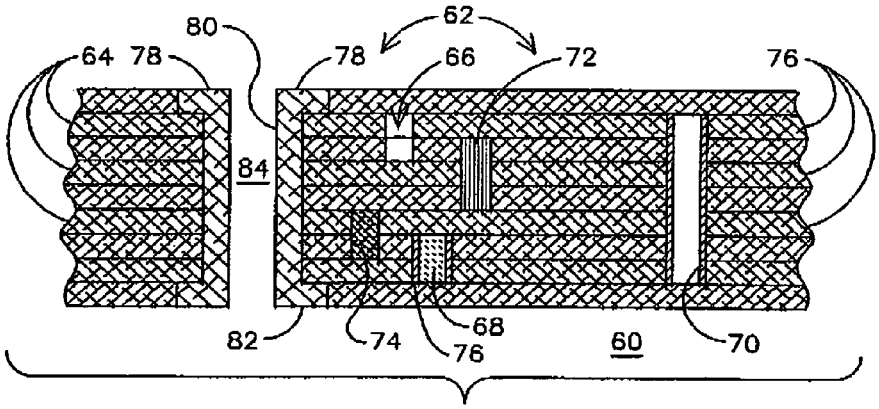
FIG. 4 is a partial cross-sectional view of a lamellate assembly including several embodiments of shear force bearing structures.

FIG. 4 illustrates a lamellate assembly 60 including several embodiments of shear force bearing structures in the form of shear pins 62 of various forms. Each shear pin 62 extends across the interface between at least two lamellae 64 to provide additional strength against relative movement between the lamellae resulting from a bending or twisting force. The shear pins 62 are each disposed within aligned holes formed in adjacent lamella, such as holes 66. The holes 66 may be formed into each fully or partially cured CMC lamella 64 by laser or water jet cutting, for example. The holes 66 may extend through only two lamellae 64 or more to group the lamellae into the desired number of subsets. A shear pin 62 is inserted into the aligned holes 66 as the assembly 60 is laid up. The pins may be a solid monolithic ceramic material 68, a hollow ceramic tube 70, a fiber bundle 72, a CMC material 74 or other compatible material or combination thereof. Hollow structures 70 may further function to direct cooling air in some applications. The holes 66 may be sized to provide a tight fit around the pins 62 to encourage a sintering joint there between, and/or an adhesive or other bonding material 76 may be used. The shear pins 62 may be used with or without a bonding material 76 being applied between the lamellae 64. The shear pin 62 may be installed in a green or partially fired state so that sintering shrinkage of the pin during final curing imposes an interlaminar compressive stress on the assembly 60. Alternatively, the shear pins 62 may be co-cured with the lamellae 64, with our without adhesive material 76.

A further embodiment of a shear pin 62 is clamp 78, which may be formed of a CMC material that is laid up to include a central web portion 80 and opposed flange portions 82 that overlap onto a topmost and bottommost lamellae in a clamped subset of the lamellae 64. The central web portion may be tubular in shape and the flange portions may be circular in cross-section. Alternatively, the clamp may be cut from a flat plate of material to have a generally C-shape defined by a central web portion 80 and opposed flange portions 82. Two such flat C-shaped clamps 78 are illustrated in FIG. 4 as being spaced apart from each other within a hole 84 formed through adjacent lamellae 76. The hole formed in the lamellae at the topmost and bottommost positions of the clamp 78 are formed to have openings large enough to receive the respective flange portions 82. The reinforcing material in the central tubular portion 80 of the CMC clamp 78 may be oriented orthogonally to the reinforcing material in the lamellae 64. Sintering shrinkage of the clamp 78 during firing would provide a compressive preload to the grouped subset of lamellae that are captured by the opposed flange portions 82. By using a plurality of clamps 78 capturing an overlapping plurality of subsets of the lamellae, a compressive pre-load may be applied to the entire lamellate assembly 60 that is in place of and/or in addition to the compressive stress that is applied by a fastener. The clamp 78 may further be formed from a braided ceramic fiber rope wherein a central web portion 80 of the rope is inserted into a hole 84 and the opposed flange portions 82 of the clamp 78 are formed by splaying out the fibers of the rope on either end of the central web portion 80. In some embodiments of the present invention, including some embodiments utilizing such clamps 78, there may be no need for a pre-compression force to hold the lamellate assembly together. Accordingly, a fastener 28 as illustrated in FIG. 2 may not be needed in all lamellate assemblies of the present invention.

Figure 5:
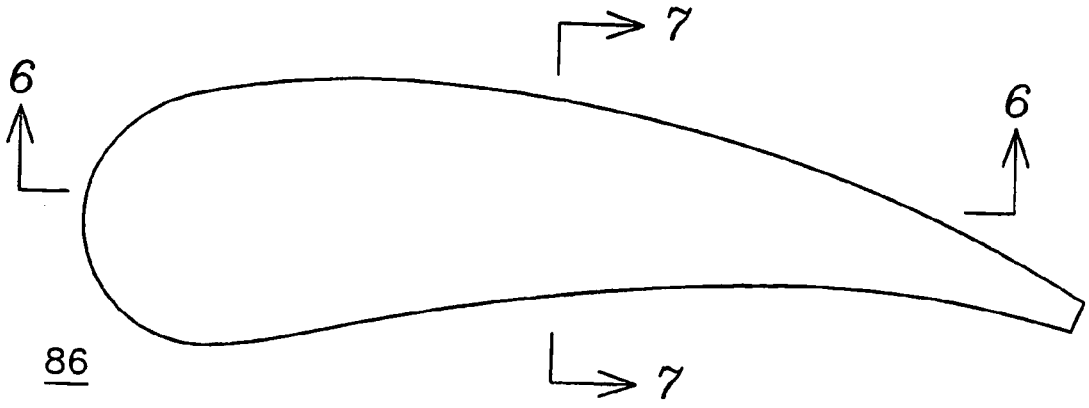
FIG. 5 is an end view of a lamellate airfoil.
Figure 6:
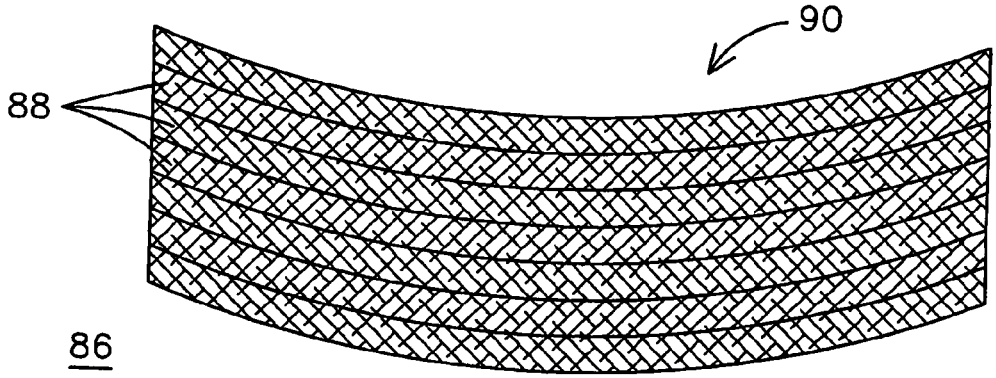
FIG. 6 is a sectional view of the airfoil of FIG. 5 along section 6—6.
Figure 7:
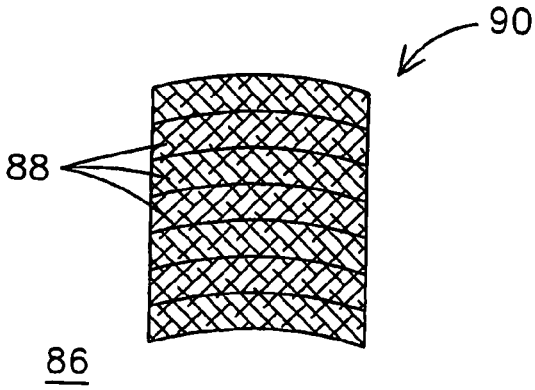
FIG. 7 is a sectional view of the airfoil of FIG. 5 along section 7—7.

FIGS. 5–7 provide three different views of a lamellate airfoil 86 wherein the shear force bearing structure 48 is formed integral to each lamella 88. Specifically, the shear force bearing structure is a warp 90 formed into each individual lamella 88. FIG. 5 is an end view of the airfoil 86 showing section locations 6—6 and 7—7 that are used to provide the sectional views of FIGS. 6 and 7 respectively. The warp 90 is a double curvature (saddle surface) as can be seen in the opposed directions of curvature seen in FIGS. 6 and 7. Each lamella 88 has the identical warp 90 so that they mesh together when stacked, and an individual lamella 88 cannot slip relative to the adjacent lamella without causing the height of the stack to increase. Such an increase in stack height would be resisted by the clamping action of any preloading tie rod (such as illustrated in FIG. 2), even if the preload has been substantially relaxed during operation of the airfoil 86. In this manner, slippage between adjacent lamella in the lamellate assembly caused by shear (twisting) forces is geometrically restrained. The warp 90 may be any desired curve such as a standard mathematical saddle surface shape. The amount of curvature shown in FIGS. 6–7 is exaggerated to clearly demonstrate the concept. For most applications, only a small amount of warp 90 is required. Typically, a distance equal to the thickness of the lamella 88 should be sufficient as the maximum axial (out of plane) deviation of the surface position across the lamella 88. For a typical CMC wafer this may be in the range of 3–6 mm, or in some applications as little as 0.5 mm. Although the present inventors have not manufactured warped lamella, it is anticipated that standard manufacturing processes used to produce flat CMC wafers may be modified somewhat to produce lamella 88 having such a slight warp 90.

Figure 8:
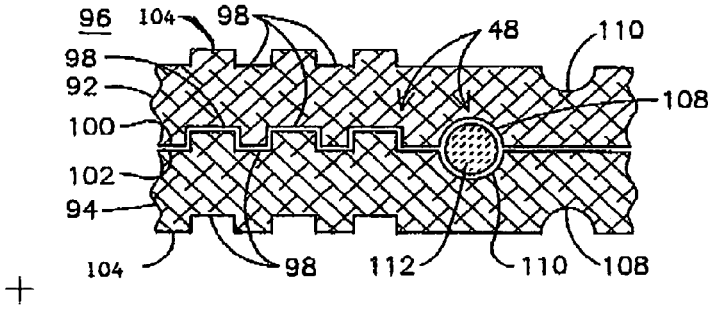
FIG. 8 is a partial cross-sectional view of adjoining lamellae illustrating shear force bearing labyrinth and rope seals.

FIG. 8 is a partial cross-sectional view of two lamellae 92, 94 of a lamellate assembly 96 illustrating two further embodiments of a shear force bearing structure 48. A plurality of grooves 98 are formed into the adjoining surfaces 100, 102 of adjoining lamella 92, 94 forming part of the lamellar assembly that may be an airfoil or other structure that will be subjected to shear forces along the plane of intersection between lamella. The material defining surfaces 100, 102 between adjacent grooves 98 form a plurality of tongues 104 that are cooperatively associated with respective grooves 98 in the opposed adjoining surface 100, 102. The tongue 104 and groove 98 geometry between the lamellae 92, 94 provides two functions: it acts as a shear force bearing structure for resisting sliding movement between the lamellae 92, 94, and it acts as a labyrinth seal for limiting fluid leakage between the lamellae 92, 94. One may appreciate that when cooling air is passed along through thickness holes, such as cooling passages 106 illustrated in FIG. 1, the leakage of such fluid between the lamellae is undesirable and would be resisted by the structure of FIG. 8. The depths of the grooves 98 may all be the same, or they may vary across the lamellae 92, 94. The maximum depth of a groove 98 may be limited so as to preserve a required degree of strength in the respective lamella 92, 94. In one embodiment, grooves 98 having a depth below the surface in the range of 1–3 mm may be formed into an oxide-oxide CMC lamella having an overall thickness of about 12 mm. In another embodiment, grooves 98 having a depth below the surface of only 0.5 mm may be formed into an oxide-oxide CMC lamella having an overall thickness of about 3–6 mm. The grooves 98 may be formed during the original manufacturing of the lamella or they may be cut into an originally manufactured flat surface.

FIG. 8 also illustrates two semi-circular grooves 108, 110 disposed adjacent each other in the opposed surfaces 100, 102 for receiving a sealing member such as rope seal 112. The rope seal 112 prevents or limits the passage of fluid between the surfaces 100, 102. The rope seal 112 will also function as a shear force bearing structure for resisting relative sliding between the surfaces 100, 102. Other shapes of grooves and sealing members may be used, such as rectangular or square, and the shape and size of the sealing member may affect it performance as a seal and as a shear force bearing structure. The sealing member may be ceramic or metal, for example a rope seal 112 made of a ceramic fiber braid or ceramic/metal hybrid material. When a plurality of rope seals 112 are used, the location of the seals between adjoining lamellae may be staggered in the in-plane direction in order to maintain a desired lamella thickness surrounding the rope seal 112. This is accomplished by the displacing the relative in-plane locations of the semi-circular grooves 108, 110 on the respective top surface 110 and bottom surface 108 of each lamella 91, 94 as shown in FIG. 8. One may appreciate that lamella 92 may be part of a subset of lamellae (not shown) that extends above lamella 92, and similarly lamella 94 may be a part of a subset of lamellae (not shown) that extends below lamella 94. In this manner, the tongue 104 and groove 98 structure and/or the sealing member may be only one of a plurality of structures that collectively bind a grouped subset of the lamella.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A lamellate airfoil assembly comprising:

a stacked plurality of ceramic matrix composite lamellae each comprising a peripheral surface collectively defining an airfoil shape;

a fastener applying a compressive pre-load to the stacked lamellae in a through thickness direction; and a plurality of shear force bearing structures separate from the fastener and disposed to resist sliding movement in an in-plane direction between adjacent ones of the lamellae, each shear force bearing structure in contact with a respective subset of the plurality of lamellae, with at least one lamella of each subset being part of another subset so that collectively the plurality of shear force bearing structures secure all of the lamellae against relative sliding movement;

wherein the shear force bearing structures comprise a shear pin extending in the through thickness direction between the adjacent ones of the lamellae;

wherein the shear pin comprises a clamp comprising a central web portion extending in the through thickness direction between the two adjacent ones of the lamellae and a flange portion at each opposed end of the web portion extending over the respective adjacent one of the lamellae.

2. The airfoil assembly of claim 1, wherein the shear pin comprises a ceramic matrix composite material.

3. The airfoil assembly of claim 1, wherein the clamp comprises a ceramic fiber rope comprising a central web portion and opposed flange portions comprising splayed out fibers of the rope on opposed ends of the central web portion.

4. A lamellate airfoil assembly comprising:

a stacked plurality of ceramic matrix composite lamellae each comprising a peripheral surface collectively defining an airfoil shape;

a fastener applying a compressive pre-load to the stacked lamellae in a through thickness direction; and a plurality of shear force bearing structures from the fastener and disposed to resist sliding movement in an in-plane direction between adjacent ones of the lamellae, each shear force bearing structure in contact with a respective subset of the plurality of lamellae, with at least one lamella of each subset being part of another subset so that collectively the plurality of shear force bearing structures secure all of the lamellae against relative sliding movement;

wherein the shear force bearing structure comprises a warp formed in each of the adjacent ones of the lamella;

wherein the warp of each lamella comprises a double curvature saddle surface shape.

5. A lamellate airfoil assembly comprising:

a stacked plurality of ceramic matrix composite lamellae each comprising a peripheral surface collectively defining an airfoil shape;

a fastener applying a compressive pre-load to the stacked lamellae in a through thickness direction;

a plurality of shear force bearing structures separate from the fastener and disposed to resist sliding movement in an in-plane direction between adjacent ones of the lamellae, each shear force bearing structure in contact with a respective subset of the plurality of lamellae, with at least one lamella of each subset being part of another subset so that collectively the plurality of shear force bearing structures secure all of the lamellae against relative sliding movement;

a first groove formed in a first of the adjacent ones of the lamellae;

a second groove formed in a second of the adjacent ones of the lamellae adjoining the first of the lamellae;

a sealing member disposed in a space defined by the first groove and the second groove.

6. The airfoil assembly of claim 5, wherein the sealing member comprises a rope seal.

7. A lamellate assembly comprising:

a stacked plurality of lamellae each comprising an anisotropic ceramic matrix composite material exhibiting an in-plane tensile strength substantially greater than a through thickness tensile strength; and a means for resisting relative sliding movement of the lamellae;

wherein the means for resisting relative sliding movement comprises a shear pin extending in the through thickness direction between at least two adjacent ones of the lamellae;

wherein the shear pin comprises a clamp comprising a central tubular portion extending in the through thickness direction between the at least two adjacent ones of the lamellae and a flange portion at each opposed end of the tubular portion extending over a respective one of the at least two adjacent ones of the lamellae.

8. The lamellate assembly of claim 7, wherein the clamp comprises a ceramic fiber rope comprising a central web portion extending through adjacent lamellae and opposed flange portions comprising splayed out fibers of the rope on opposed ends of the central web portion.

9. A lamellate assembly comprising:

a stacked plurality of lamellae each comprising an anisotropic ceramic matrix composite material exhibiting an in-plane tensile strength substantially greater than a through thickness tensile strength; and a means for resisting relative sliding movement of the lamellae;

wherein the means for resisting relative sliding movement comprises a respective warp formed in each or two adjacent lamellae;

wherein the warp comprises a double curvature saddle surface shape.

10. A lamellate assembly comprising:

a stacked plurality of lamellae each comprising an anisotropic ceramic matrix composite material exhibiting an in-plane tensile strength substantially greater than a through thickness tensile strength; and a means for resisting relative sliding movement of the lamellae further comprising:

a first groove formed in a first lamella;

a second groove formed in a second lamella adjoining the first lamella; and a sealing member disposed in a space defined by the first groove and the second groove.

11. The airfoil assembly of claim 10, wherein the sealing member comprises a rope seal.

12. A lamellate assembly comprising:

a stacked plurality of individual ceramic matrix composite lamellae;

a first subset of adjacent ones of the lamellae interconnected by a stitch;

a second subset of adjacent ones of the lamellae interconnected by a stitch;

wherein the first subset of lamellae and the second subset of lamellae comprise at least one lamella in common.

13. The lamellate assembly of claim 12, the stitches are shrunk relative to their respective lamellae, thereby causing compressive stresses to be applied to the lamellae.

* * * * *